US010898055B2

(12) United States Patent
Wöbkemeier

(10) Patent No.: US 10,898,055 B2
(45) Date of Patent: Jan. 26, 2021

(54) WATER-GUIDING DOMESTIC APPLIANCE AND METHOD FOR OPERATING A WATER-GUIDING DOMESTIC APPLIANCE

(71) Applicant: BSH Hausgeräte GmbH, Munich (DE)

(72) Inventor: Martina Wöbkemeier, Berlin (DE)

(73) Assignee: BSH Hausgeräte GmbH, Munich (DE)

( * ) Notice: Subject to any disclaimer, the term of this patent is extended or adjusted under 35 U.S.C. 154(b) by 467 days.

(21) Appl. No.: 15/742,898

(22) PCT Filed: Aug. 15, 2016

(86) PCT No.: PCT/EP2016/069341
§ 371 (c)(1),
(2) Date: Jan. 9, 2018

(87) PCT Pub. No.: WO2017/032629
PCT Pub. Date: Mar. 2, 2017

(65) Prior Publication Data

US 2018/0214001 A1 Aug. 2, 2018

(30) Foreign Application Priority Data

Aug. 21, 2015 (DE) ..... 10 2015 215 984

(51) Int. Cl.
*A47L 15/00* (2006.01)
*A47L 15/42* (2006.01)

(52) U.S. Cl.
CPC ..... *A47L 15/4295* (2013.01); *A47L 15/0049* (2013.01); *A47L 2401/04* (2013.01); *A47L 2401/30* (2013.01); *A47L 2501/26* (2013.01)

(58) Field of Classification Search
CPC ..... A47L 15/0049; A47L 15/4295; A47L 2401/04; A47L 2401/30; A47L 2501/26
USPC ..... 134/18, 25.2, 56 D, 57 D, 58 D, 113, 134/115 R
See application file for complete search history.

(56) References Cited

U.S. PATENT DOCUMENTS

| | | | |
|---|---|---|---|
| 7,842,137 | B2 | 11/2010 | Classen et al. |
| 8,007,597 | B2 | 8/2011 | Beaudet et al. |
| 2007/0272272 | A1 | 11/2007 | Choi et al. |
| 2011/0248609 | A1 | 10/2011 | Hoepfl et al. |
| 2015/0053237 | A1 | 2/2015 | Lee |

FOREIGN PATENT DOCUMENTS

| | | | |
|---|---|---|---|
| CN | 101014276 | A | 8/2007 |
| DE | 4142463 | A1 | 6/1993 |
| DE | 10048081 | A1 | 4/2002 |
| DE | 10048088 | A1 | 4/2002 |
| DE | 10058086 | A1 | 4/2002 |
| EP | 1925250 | A1 | 5/2008 |
| WO | 2011080232 | A1 | 7/2011 |

OTHER PUBLICATIONS

National Search Report CN 2016800482923 dated Nov. 20, 2019.
International Search Report PCT/EP2016/069341 dated Nov. 7, 2016.
National Search Report DE 10 2015 215 984.1 dated Jul. 12, 2016.

*Primary Examiner* — Levon J Shahinian
(74) *Attorney, Agent, or Firm* — Michael E. Tschupp; Andre Pallapies; Brandon G. Braun

(57) ABSTRACT

A water-conducting domestic appliance includes a detection unit configured to detect a type of item to be washed as the item is loaded into the water-conducting domestic appliance, and an output unit configured to output a signal carrying information for a user as a function of the detected type of item.

28 Claims, 7 Drawing Sheets

WATER-GUIDING DOMESTIC APPLIANCE AND METHOD FOR OPERATING A WATER-GUIDING DOMESTIC APPLIANCE

CROSS-REFERENCES TO RELATED APPLICATIONS

This application is the U.S. National Stage of International Application No. PCT/EP2016/069341, filed Aug. 15, 2016, which designated the United States and has been published as International Publication No. WO 2017/032629 A1 and which claims the priority of German Patent Application, Serial No. 10 2015 215 984.1, filed Aug. 21, 2015, pursuant to 35 U.S.C. 119(a)-(d).

BACKGROUND OF THE INVENTION

The present invention relates to a water-conducting domestic appliance, for example a dishwasher, and a method for operating a water-conducting domestic appliance.

Until now items to be washed have generally been arranged manually in a dishwasher based on intuition. Often every user develops a method for arranging them which is tailored individually to said user's household. If another user wants to arrange the items to be washed in the dishwasher, verbal instruction or supervision of the method for arranging them will often be required. General instructions for arranging items to be washed from the manufacturer are often not suitable, as they are based on a model standard place setting and therefore not tailored to the individual household.

It is also desirable to avoid loading an item to be washed which is not suitable for cleaning in the dishwasher into said dishwasher.

The patent specification DE 100 48 081 A1 shows a program-controlled dishwasher with an image recognition system for detecting a load or the soiling of items to be washed. WO 2006/015934 A1 shows a dishwasher with an image acquisition system for generating a three-dimensional image of the wash compartment contactlessly. U.S. Pat. No. 8,007,597 B2 shows a dishwasher with a touch screen display for displaying instructions for use. WO 2011/080232 A1 shows a dishwasher for detecting thermal properties of items to be washed, in order to determine a type, position and quantity of items to be washed.

BRIEF SUMMARY OF THE INVENTION

With this in mind it is an object of the present invention to provide an improved water-conducting domestic appliance.

Accordingly a water-conducting domestic appliance is proposed, which has a detection unit for detecting a type of item to be washed as said item to be washed is being loaded into the water-conducting domestic appliance and an output unit for outputting a signal carrying information for a user as a function of the detected type of item to be washed. The water-conducting domestic appliance is in particular a domestic dishwasher. The user relates in particular to a person operating the water-conducting domestic appliance.

The type of item to be washed can be detected and the signal containing the information for the user can be output in particular as the item to be washed is being loaded into a wash container of the water-conducting domestic appliance. The user can thus be informed for example which items to be washed should be positioned where in the water-conducting domestic appliance. It is conceivable for the items to be washed to be loaded into the water-conducting domestic appliance with the aid of a robot, which arranges the items to be washed in the water-conducting domestic appliance according to the signal containing the information for the user.

For example the detection unit can comprise one or more sensors, which can detect a spatial extension and/or the material properties of the items to be washed being loaded into the water-conducting domestic appliance. The type of item to be washed can be detected based on the detected spatial extension and/or the material properties of the item to be washed. Alternatively or additionally the detection unit can assign the item to be washed to one of several previously stored types of items to be washed on the basis of the detected spatial extension and/or the material properties of the item to be washed. The detection unit can be activated when the water-conducting domestic appliance is opened, for example when a door of the same is opened, in order to detect the type of item to be washed being loaded. The detection unit here can be integrated or positioned in or on a door, an operating element, a display, a housing, a wash chamber, a wash container, on a top, side wall and/or rear wall of the water-conducting domestic appliance. The detection unit can be configured in particular so that it can be folded out or up and/or removed and mounted.

The type of item to be washed can comprise a tableware item, flatware item and/or kitchen, eating or drinking utensil item. The item to be washed is therefore for a mug, glass, cup, knife, fork, spoon, plate, bowl, pot, pan, dish or the like. The spatial extension of the item to be washed can comprise a shape, width, length, thickness, depth, height, diameter, proportion and/or a ratio thereof to one another. The material property of the item to be washed can comprise a material, material distribution and/or presence of a defined material (e.g. precious metal, metal, glass, ceramic or wood) in or on the item to be washed.

The items to be washed in a household with the water-conducting domestic appliance can be country or region-specific. For example the majority of the items to be washed in a European household may correspond to the standard EN 50242 and/or what is referred to as a standard place setting. The detection unit can be designed to recognize household-specific, country-specific and/or region-specific items to be washed. The signal carrying the information for the user can be generated and output according to the individual items to be washed in the respective household. The water-conducting domestic appliance can thus provide assistance which is tailored individually to the respective household as the items to be washed are being loaded.

The information for the user can include a predefined position of the items to be washed in the water-conducting domestic appliance, in particular in its wash container. The predefined position of the items to be washed can in particular be an advantageous, energy-saving, water-saving, environmentally friendly and/or efficient positioning of the items to be washed in the water-conducting domestic appliance. Alternatively or additionally the predefined position can correspond to an individual arrangement of items to be washed of one of several users.

The information for the user can also include information about the item to be washed and/or an operating state, for example a capacity, of the water-conducting domestic appliance, which can influence the processing (e.g. washing or drying) of the item to be washed. This provides the user with further information as the item to be washed is being loaded into or arranged in the water-conducting domestic appliance.

The signal carrying the information for the user is preferably an electronic signal. The output unit can output the signal in particular optically and/or acoustically. The outputting of the signal here can include processing the signal and reproducing the processed signal. The output unit can comprise an optical display facility, for example a display, screen and/or projection unit (e.g. a projector) or can be connected to an optical display facility or be integrated in an optical display facility.

According to one embodiment the water-conducting domestic appliance is designed to determine an arrangement of the items to be washed with the aid of the detected type and with the aid of a position of the items to be washed in a wash container of the water-conducting domestic appliance. The water-conducting domestic appliance is also designed to compare the arrangement of the items to be washed with a previously stored arrangement. The water-conducting domestic appliance is also designed to store the determined arrangement.

The arrangement of the items to be washed can relate to a positioning of items to be washed in the water-conducting domestic appliance, in particular in its wash container. For example the arrangement of the items to be washed can be determined with the aid of an illustration, projection, table showing the type and position of items to be washed positioned in the water-conducting domestic appliance and/or an acquired image of items to be washed in the same. Conversely the type and position of the items to be washed positioned in the water-conducting domestic appliance can be detected with the aid of a determined arrangement.

At least one arrangement of items to be washed can be supplied to the water-conducting domestic appliance and be present as at least one previously stored arrangement in a memory unit. The water-conducting domestic appliance can be configured with internet capability and the arrangement can be supplied and/or updated by way of the internet, for example by a server of the domestic appliance manufacturer. The determined arrangement of the items to be washed can be compared with the at least one previously stored arrangement. If the determined arrangement is similar to one of the at least one previously stored arrangements, the determined arrangement can be assigned to the respective previously stored arrangement. Similarity can be determined based on commonalities of type and position of items to be washed in the different arrangements. The similarity of arrangements can be determined for example with the aid of an algorithm or computer program, for example an image analysis or image or pattern recognition. Alternatively or additionally models can be produced based on the detected type and position of the items to be washed and the similarity of the arrangements can be determined based on said models. If the determined arrangement matches none of the previously stored arrangements, the determined arrangement can be stored additionally as a further previously stored arrangement.

The detection unit is preferably suitable for determining the arrangement of the items to be washed with the aid of the detected type and with the aid of the position of the items to be washed in the wash container. Alternatively or additionally the water-conducting domestic appliance has a control unit, which is designed to determine the arrangement with the aid of the detected type and with the aid of the position. The detection unit, the control unit and the output unit are preferably linked to one another for this purpose.

The detection unit is preferably suitable for determining a user-typical arrangement with the aid of the detected type and position of the items to be washed. It is then possible to determine and store an individual arrangement of the respective user of the number of users in a household in which there are a number of users using the water-conducting domestic appliance. The information for the user can correspond to the individual arrangement of a specific user.

The position of the items to be washed can indicate where the items to be washed are or can be positioned in the wash container of the water-conducting domestic appliance. For example the position is determined as a position in a lower rack, upper rack, shelf and/or flatware drawer. The position can also be determined in relation to one or more loading levels of the water-conducting domestic appliance. The position of the items to be washed in the wash container can be determined optically. The detection unit is preferably designed to detect the position of the items to be washed in the wash container.

According to a further embodiment the water-conducting domestic appliance is designed to recognize a reproducibility of the previously stored arrangement in the determined arrangement and, if reproducibility is recognized, to determine a predefined position of the items to be washed in the wash container according to the determined arrangement and/or the previously stored arrangement.

Reproducibility relates for example to a frequency with which the arrangement determined as the items to be washed are being loaded into the water-conducting domestic appliance corresponds to one of the previously stored arrangements. A threshold value for frequency can be predefined and reproducibility can be present when the frequency of one of the previously stored arrangements reaches or exceeds the threshold value. To this end the frequency can be registered electronically. Frequency and reproducibility can be stored as electronic data, for example in binary form, in a memory unit.

If the reproducibility of one of the previously stored arrangements is determined, the position of the items to be washed of a defined type in this previously stored arrangement can be defined as the predefined position of the items to be washed of the defined type. The previously stored arrangement with the predefined position of the items to be washed can be an advantageous, energy-saving, water-saving, environmentally friendly and/or efficient positioning of the items to be washed in the water-conducting domestic appliance.

The information for the user preferably indicates the predefined position of the items to be washed in the water-conducting domestic appliance as a function of the type of item to be washed. The water-conducting domestic appliance can thus make suggestions to the user relating to the position of the items to be washed in the water-conducting domestic appliance in real time.

According to a further embodiment the detection unit comprises an optical detection unit for detecting the type of item to be washed optically.

The detection unit can comprise one or more optical sensors for detecting the type of item to be washed. The optical detection of the type of item to be washed can comprise an image analysis and/or an optical measurement (e.g. of reflection, transparency, emission and/or colors).

According to a further embodiment the water-conducting domestic appliance comprises a recording unit for recording a position and type of items to be washed positioned in the water-conducting domestic appliance.

The recording unit produces for example an acquired image of the items to be washed that are positioned in the water-conducting domestic appliance. The recording unit preferably records the arrangement of the items to be washed that are positioned in the water-conducting domestic appliance. The acquired image can be used to detect and assign the position and type of the items to be washed. If the items to be washed are loaded gradually into the water-conducting domestic appliance, the recording unit can record the type and position of the items to be washed before and after loading. For example a control unit can compare the acquired image of the items to be washed before and after loading and update the type and position of the items to be washed. Alternatively or additionally the recording unit can record the type and position of the items to be washed or the arrangement directly before the start of a wash cycle.

According to a further embodiment the detection unit is designed to detect the type of item to be washed with the aid of an image of the items to be washed positioned in the water-conducting domestic appliance acquired by an image acquisition facility.

The image acquisition facility can be an internal image acquisition facility, in other words integrated in the water-conducting domestic appliance, or an external image acquisition facility, in other words separate from and able to be operated independently of the water-conducting domestic appliance. The image acquisition facility can comprise a digital camera and can be part of a computation-capable mobile device, for example a smartphone, tablet or mobile computer.

The image acquisition facility acquires an image of the items to be washed positioned in the water-conducting domestic appliance. The acquired image can be transferred to the water-conducting domestic appliance, in particular a control unit and/or memory unit of the same. The acquired image can be used to determine the arrangement of the items to be washed and to assign the type and position of the items to be washed. An image analysis, image or pattern recognition can be performed to evaluate the image acquired by the image acquisition facility.

According to a further embodiment the water-conducting domestic appliance also comprises a memory unit for storing a position and type of item to be washed positioned in the water-conducting domestic appliance.

The memory unit is designed in particular to store acquired images, positions of items to be washed, types of items to be washed, determined arrangements, previously stored arrangements and/or predefined positions of items to be washed as electronic data. The memory unit can be for example an internal or external database facility and comprises for example a flash and/or USB memory.

The memory unit is preferably linked electronically to the detection unit, the output unit, optionally the recording unit and/or optionally the image acquisition unit of the water-conducting domestic appliance, in order to receive date therefrom and/or to transfer data thereto.

According to a further embodiment the information comprises a predefined position of the items to be washed in the wash container.

According to a further embodiment the information for the user comprises a recommendation that items to be washed be removed from the water-conducting domestic appliance, in particular from its wash container.

The water-conducting domestic appliance preferably outputs the recommendation to remove the items to be washed when the items to be washed are not suitable for being processed, in particular cleaned, in the water-conducting domestic appliance.

According to a further embodiment the output unit is designed to output the signal carrying the information for the user optically.

The information for the user, which is carried by the signal, can be displayed for example on a display, on a monitor and/or on an operator interface (e.g. a touch screen). The information can also be projected onto or against a surface with the aid of a projection facility, e.g. a projector. It is also conceivable for the optical outputting of the information to be assisted by an additional acoustic output.

According to a further embodiment the information comprises a warning message, if the detected type of item to be washed corresponds to a reference type.

The reference type can relate to one of several predefined types of items to be washed, which are not suitable for being processed in the water-conducting domestic appliance. The reference type of item to be washed can comprise delicate or fragile kitchen utensils, e.g. decorated plates, tableware with gold or silver edging, fragile porcelain tableware, painted items or lead crystal glasses. The user can thus receive recommendations that the delicate or fragile items to be washed should be removed from or not placed in the water-conducting domestic appliance, as the items to be washed are being loaded.

Items to be washed that are not suitable for cleaning in the water-conducting domestic appliance can also be stored manually in that the user holds the item to be washed in front of the detection unit until the type of item to be washed has been detected and said type of item to be washed is stored as a reference type.

According to a further embodiment the detection unit is designed to recognize the type and/or position of the items to be washed with the aid of pattern recognition.

An acquired image and/or a visual representation of the items to be washed that are positioned in the water-conducting domestic appliance can be evaluated with the aid of image and/or pattern recognition. This allows detection of the type and/or position of the items to be washed that are positioned in the domestic appliance. The arrangement of the items to be washed can also be determined based on the type and position of the items to be washed. Image and/or pattern recognition can be provided in the manner of a computer program or algorithm. A control unit of the water-conducting domestic appliance can be designed to perform the image and/or pattern recognition.

According to a further embodiment the output unit is designed to transmit the signal carrying the information for a user to an external output facility.

The external output facility can be for example a tablet, smartphone, computer, monitor or the like. The external output facility can be equipped with its own computation unit, which processes the received signal and outputs the information for the user visually and/or acoustically. Alternatively or additionally the external output facility can have a display facility, which is suitable for displaying the information. This allows or facilitates remote monitoring of the water-conducting domestic appliance. One option is for example an application (or app) for a mobile device, which allows communication between the mobile device and the water-conducting domestic appliance.

The water-conducting domestic appliance, in particular its detection unit and/or output unit, can also be such that it can be controlled with the aid of the external output facility.

According to a further embodiment the water-conducting domestic appliance comprises at least one light barrier for monitoring the type and/or position of the items to be washed in the wash container.

The at least one light barrier can emit and receive for example a monochromatic light, in order to monitor a spatial extension of the items to be washed that are positioned in the wash container of the water-conducting domestic appliance. An item to be washed, the spatial extension of which is too great for the wash container, can be registered by one of the light barriers, whereupon a warning message or recommendation that said item to be washed should be removed can be output.

According to a further embodiment the detection unit is positioned on a wash container and/or on a door of the water-conducting domestic appliance.

In particular the detection unit can be removed and mounted at a number of points on the water-conducting domestic appliance. A number of detection units can also be provided in and/or on the water-conducting domestic appliance.

A method for operating a water-conducting domestic appliance, in particular the water-conducting domestic appliance proposed above, is also proposed. With this a type of item to be washed is detected as said item to be washed is being loaded into the water-conducting domestic appliance and a signal is output, which carries information for a user as a function of the detected type of item to be washed.

A computer program product is also proposed, which prompts the performance of the method as described above on a program-controlled facility.

A computer program product, for example a computer program tool, can be provided or supplied for example in the manner of a storage medium, for example a memory card, USB stick, CD-ROM, DVD or even in the form of a downloadable file from a server in a network. This can be done by transmitting a corresponding file containing the computer program product or the computer program tool for example in a wireless communication network.

The embodiments and features described for the proposed water-conducting domestic appliance apply correspondingly to the proposed method.

Further possible implementations of the invention also comprise combinations of features or embodiments described above or in the following in relation to the exemplary embodiments, which have not been specifically cited. The person skilled in the art will also add individual aspects to improve or supplement the respective basic form of the invention.

BRIEF DESCRIPTION OF THE DRAWINGS

Further advantageous configurations and aspects of the invention are set out in the subclaims and the exemplary embodiments of the invention described in the following. The invention is described in more detail below based on preferred embodiments with reference to the accompanying figures.

BRIEF SUMMARY OF THE INVENTION

Figure 1:
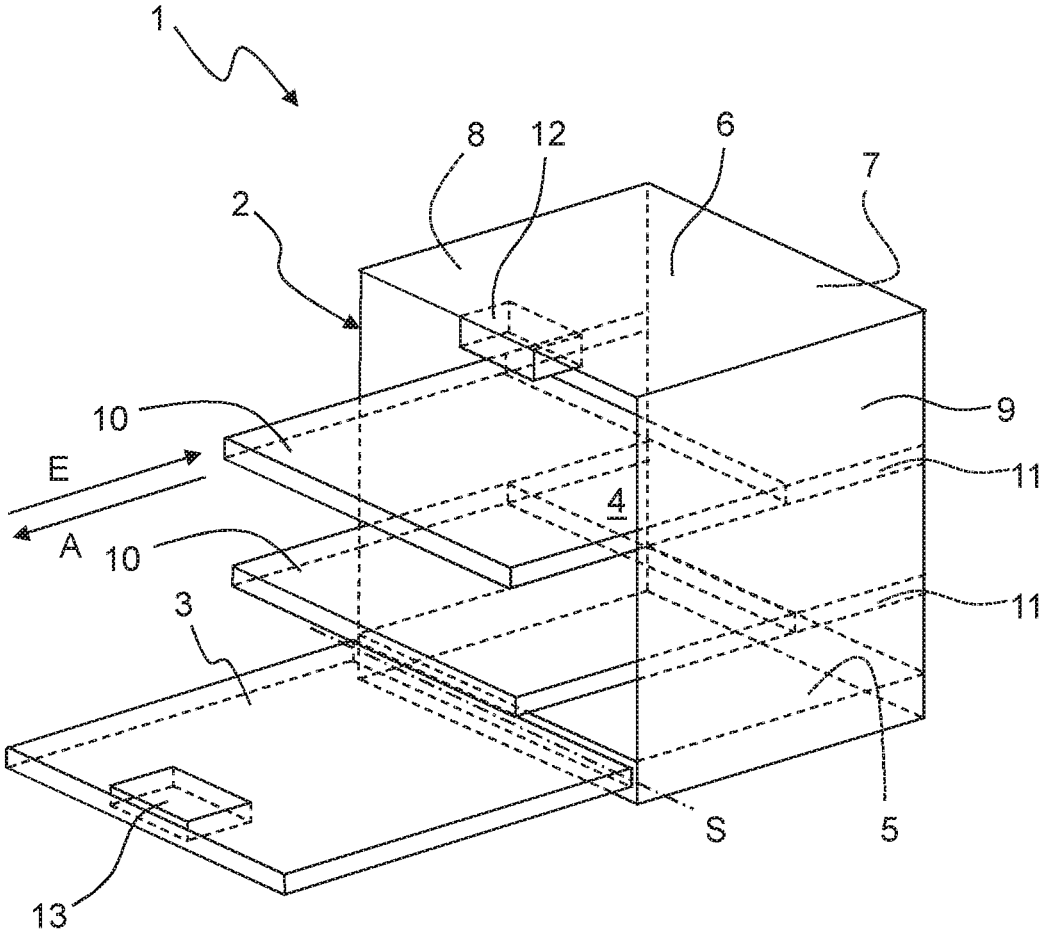
FIG. 1 shows a perspective view of a first embodiment of a water-conducting domestic appliance.

Identical elements or those of identical function are shown with the same reference characters in the figures, unless otherwise specified.

FIG. 1 shows a perspective view of a first embodiment of a water-conducting domestic appliance 1. In the example in FIG. 1 the domestic appliance 1 is a dishwasher.

The dishwasher 1 has a wash container 2 and a door 3. The wash container 2 and door 3 form a wash chamber 4 for washing items to be washed. The door 3 is shown in its opened position in FIG. 1. The door 3 can be closed or opened by pivoting about a pivot axis S provided at a lower end of the door 3.

The wash container 2 is for example cube-shaped and can comprise a base 5, a top 6 opposite the base 5, a rear wall 7 opposite the door 3 and two opposing side walls 8, 9. The side walls 8, 9 in particular can be made of stainless steel sheet.

The dishwasher 1 also has at least one loading level 10. The at least one loading level 10 is preferably a holder for items to be washed in the dishwasher 1. In particular a number of loading levels 10 can be provided, comprising a lower rack, upper rack and/or flatware drawer. The several loading levels 10 are preferably positioned one above the other in the wash container 2. Each loading level 10 can be moved as required in an insertion direction E into the wash container 2 or in a pull-out direction A out of it. To this end a rail 11 is preferably provided on both sides of a respective loading level 10.

The dishwasher 1 has a detection unit 12, which is fastened to the top 6 by way of example in FIG. 1. The detection unit 12 can be such that it can be lowered into the top 6, folded out and up or removed and mounted. The detection unit 12 can also be positioned in or on the door 3, the base 5, the rear wall 7 or one of the side walls 8, 9. The detection unit 12 can recognize a type of item to be washed introduced into the dishwasher 1 or positioned in the same. To this end the detection unit 12 has a detection region, which is directed out from the detection unit 12 in the direction of the door 3.

The dishwasher 1 also has an output unit 13, which is built into the door 3 by way of example in FIG. 1. The output unit 13 has a display or screen, on which information for a user, in other words a person operating the dishwasher 1, is displayed. The information here is based on the type of item to be washed as detected by the detection unit 12.

To load the items to be washed, for example a plate, glass, bowl or item of flatware, into the dishwasher 1, the door 3 is first opened, at least one of the loading levels 10 is pulled out of the wash chamber 4 and the items to be washed are moved toward the loading level 10. When items to be washed enter the detection region of the detection unit 12, the detection unit 12 acquires an image of said items to be washed and performs image or pattern recognition on the acquired image to recognize the type of item to be washed.

To recognize the type of item to be washed, the detection unit 12 is preferably equipped with computation capacity. Alternatively or additionally the detection unit 12 is linked to a control unit (not shown in FIG. 1), which for example receives and analyzes the image of the item to be washed acquired by the detection unit 12.

The detection unit 12 or a control unit not shown in FIG. 1 can generate an electronic signal containing information for the user after detecting the type of item to be washed. The information includes inter alia an advantageous position of the item to be washed of the type detected, for example "Cup: please lie in upper compartment", "Plate: please stand in left column in lower compartment" or "Spoon: please place in flatware basket".

If the item to be washed is not suitable for cleaning in the dishwasher 1, the information includes a warning message, for example "Caution! Item not suitable for dishwasher!".

Figure 2:
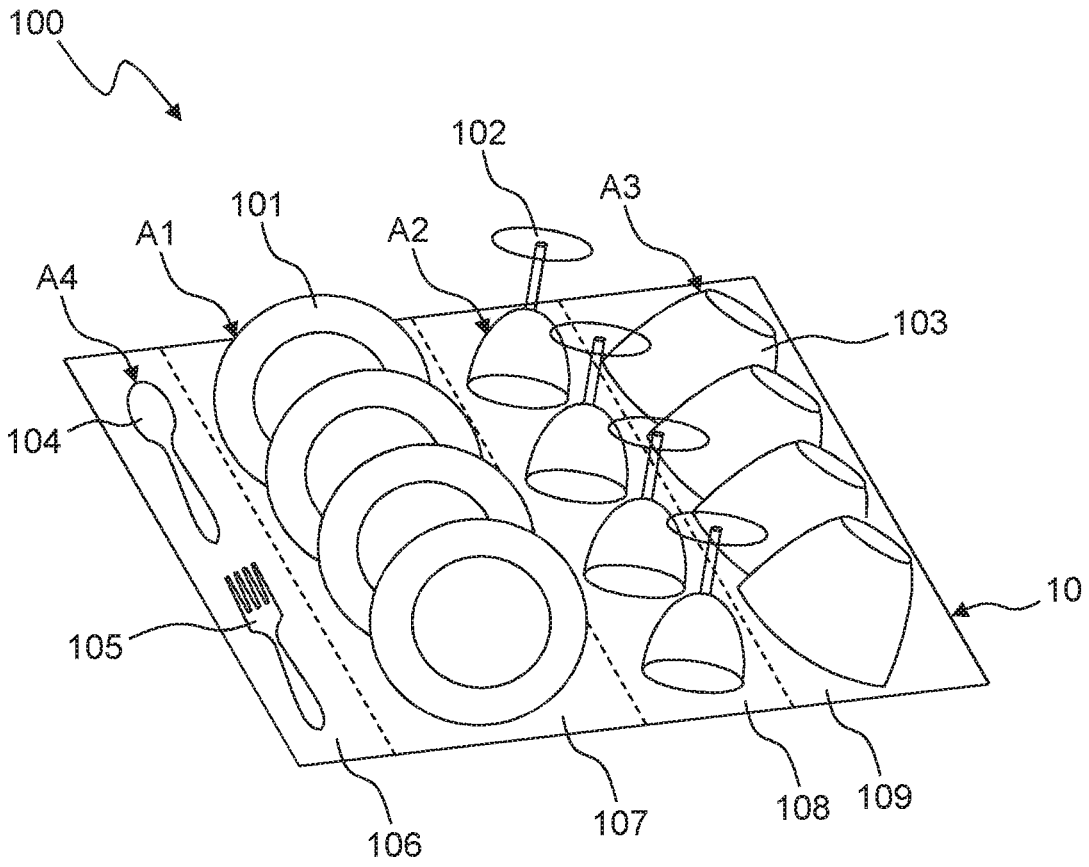
FIG. 2 shows a schematic illustration of an arrangement with different types of items to be washed.

FIG. 2 shows a schematic view of an arrangement 100 of different types A1-A4 of items to be washed 101-105.

The items to be washed in the arrangement 100 comprise a number of plates 101, a number of glasses 102, a number of bowls 103, a cooking spoon 104 and a fork 105, which are positioned in the loading level 10 of the dishwasher 1 in FIG. 1. A first type A1 of item to be washed comprises the plates 101, a second type A2 of item to be washed comprises the glasses 103, a third type A3 of item to be washed comprises the bowls 103 and a fourth type of item to be washed comprises the cooking spoon 104 and the fork 105.

The arrangement 100 is configured in such a manner that items to be washed 101-105 belonging to one type A1-A4 of items to be washed are positioned in a respective column 106-109. In FIG. 2 the plates 101 of the first type A1 of item to be washed are positioned in a second column 107 from the left, the glasses 102 of the second type A2 of item to be washed are positioned in a third column 108, the bowls 103 of the third type A3 of item to be washed are positioned in a fourth column 109 and the flatware 104, 105 of the fourth type A4 of item to be washed is positioned in the first column 106. The columns 106-109 represent a position of the respective items to be washed 101-105.

The arrangement 100 in particular represents positioning in or on one of the loading levels 10 of the dishwasher 1. The arrangement 100 is schematic and can represent a preferred positioning of items to be washed or an individual positioning of items to be washed for one user.

Figure 3:
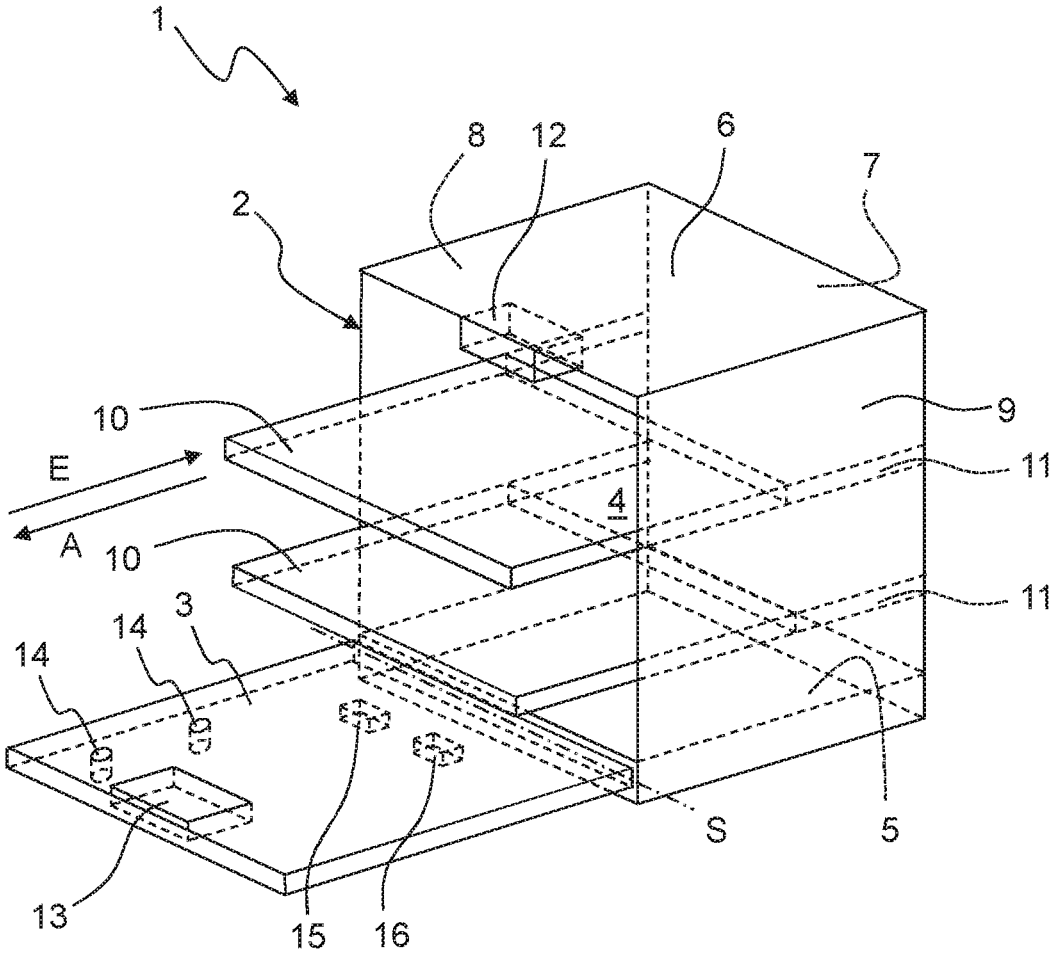
FIG. 3 shows a perspective view of a second embodiment of a water-conducting domestic appliance.

FIG. 3 shows a perspective view of a second embodiment of a water-conducting domestic appliance 1. The water-conducting domestic appliance 1 is in particular a domestic dishwasher. The second embodiment in FIG. 3 is based in particular on the first embodiment in FIG. 1 and has all the features of the first embodiment in FIG. 1.

Two recording units 14 are built into the door 3. When the door 3 is in a closed position, the recording units 14 are positioned at a vertical distance from one another such that they can each record a type and position of an item to be washed positioned in the water-conducting domestic appliance 1 in the respective loading level 10. In particular an image is acquired of an arrangement, in other words the positioning of the items being washed in the respective loading level 10. The acquired image allows the position and type of item to be washed positioned in the loading level 10 to be recognized and detected.

The recorded type and position of the items to be washed or the acquired image of the arrangement is/are transferred to a control unit 15, which is built into the door 3 by way of example in FIG. 3. The control unit 15 is equipped with computation capacity and can evaluate the recorded type and position of the items to be washed or the acquired image and determine the arrangement therefrom. To this end the control unit 15 performs an image analysis, for example an image and pattern recognition, which is provided in the manner of an algorithm or computer program.

A memory unit 16 is also provided, being positioned in the door 3. The memory unit 16 is an electronic memory unit. The recorded type and position of the items to be washed, the acquired image and/or the determined arrangement are stored as electronic data in the memory unit 16.

Alternatively or additionally the recording units 14, the control unit 15 and/or the memory unit 16 can be positioned in or on the wash container 2 of the water-conducting domestic appliance 1.

The control unit 15 can compare the determined arrangement with previously stored arrangements, in other words arrangements that have been determined beforehand and stored in the memory unit 16. The type and position in particular of the items to be washed in the different arrangements are compared in this process. If the type and position of the items to be washed in the determined arrangement match one of the previously stored arrangements, the determined arrangement is assigned to said previously stored arrangement. A frequency of assignments of the determined arrangement to the previously stored arrangement is stored in the memory unit 15 for each of the previously stored arrangements in this process.

If the frequency of one of the previously stored arrangements reaches a predefinable threshold value, for example five, the control unit 15 (or the memory unit 16) determines a reproducibility of said previously stored arrangement. The position of the items to be washed of the respective type of item to be washed according to this predefinable arrangement is assigned to a predefined position of the items to be washed of the respective type of item to be washed. When the type of item to be washed that has been loaded into the water-conducting domestic appliance 1 is detected, the information for the user, which is output with the aid of the output unit 13, includes the predefined position for the detected type of item to be washed.

If a number of users in a household load the items to be washed in the water-conducting domestic appliance 1 in turn, the reproducibility is determined for a number of previously stored arrangements and the several previously stored arrangements are stored as user-specific arrangements in the memory unit 16. As the items to be washed are loaded into the water-conducting domestic appliance 1, the detection unit 12 and/or control unit 15 recognizes the user from the determined arrangement and the output unit 13 can output individual information tailored specifically for the user.

Figure 4:
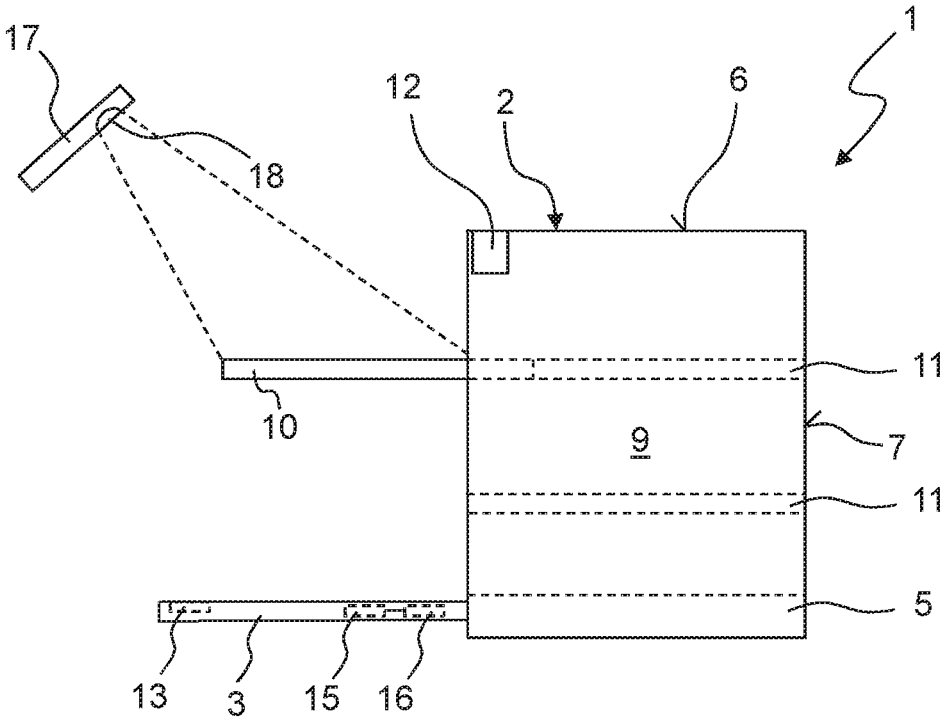
FIG. 4 shows a schematic side view of a third embodiment of a water-conducting domestic appliance with a mobile device.

FIG. 4 shows a schematic side view of a third embodiment of a water-conducting domestic appliance 1 with a mobile device 17. The third embodiment in FIG. 4 is based in particular on the first embodiment in FIG. 1 and has all the features of the first embodiment in FIG. 1.

The mobile device 17, for example a smartphone, tablet or digital camera, which is equipped with a mobile image acquisition facility 18, acquires an image of the arrangement in one of the loading levels 10. The acquired image of the arrangement can either be processed in the mobile device 17 or be transferred to the control unit 15 of the water-conducting domestic appliance 1, which analyzes the acquired image and performs an image or pattern recognition, in order to detect the type and position of the items to be washed in the arrangement. The type and position of the items to be washed thus detected can be stored in the memory unit 16.

Figure 5:
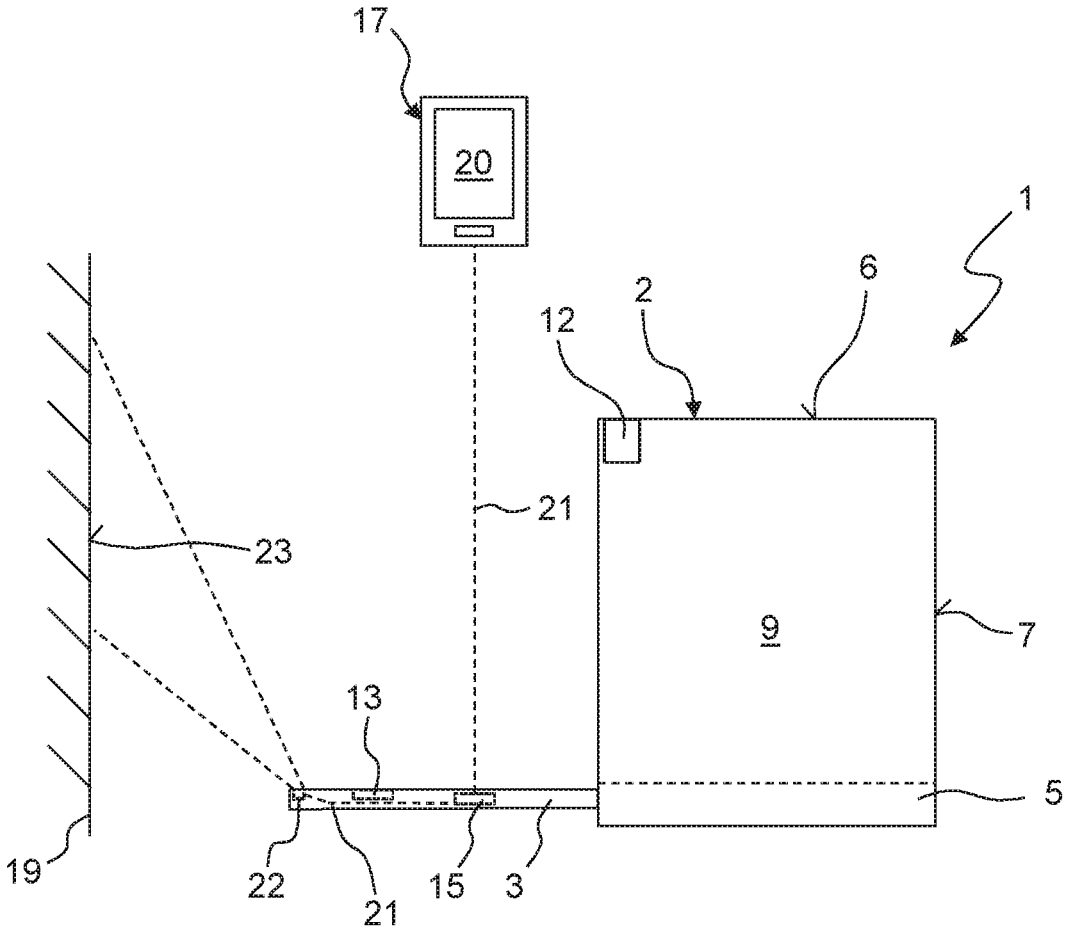
FIG. 5 shows a schematic side view of a fourth embodiment of a water-conducting domestic appliance with the mobile device in FIG. 4 and a wall.

FIG. 5 shows a schematic side view of a fourth embodiment of a water-conducting domestic appliance 1 with the mobile device 17 and a wall 19. The fourth embodiment in FIG. 5 is based in particular on the first embodiment in FIG. 1 and has all the features of the first embodiment in FIG. 1.

The mobile device 17 has a display facility 20, for example a display or screen. A signal 21 carrying the information for the user is generated by the control unit 15 and transferred to the mobile device 17. The mobile device 17 processes the signal 21 and displays the information for the user on the display facility 20.

Alternatively or additionally the information is displayed with the aid of a projection unit 22, e.g. a projector, which projects the information onto a wall 19. The projection unit 22, which is built into the door 3 of the water-conducting domestic appliance 1 in FIG. 5, receives the signal 21 carrying the information for the user from the control unit 15 and generates the information optically in a projection surface 23 on the wall 19. It is also conceivable for the projection unit 22 to be positioned in or on the top 6, one of the walls 7-9 or the base 5. The projection unit 22 can also be a removable, separate projection unit.

Figure 6:
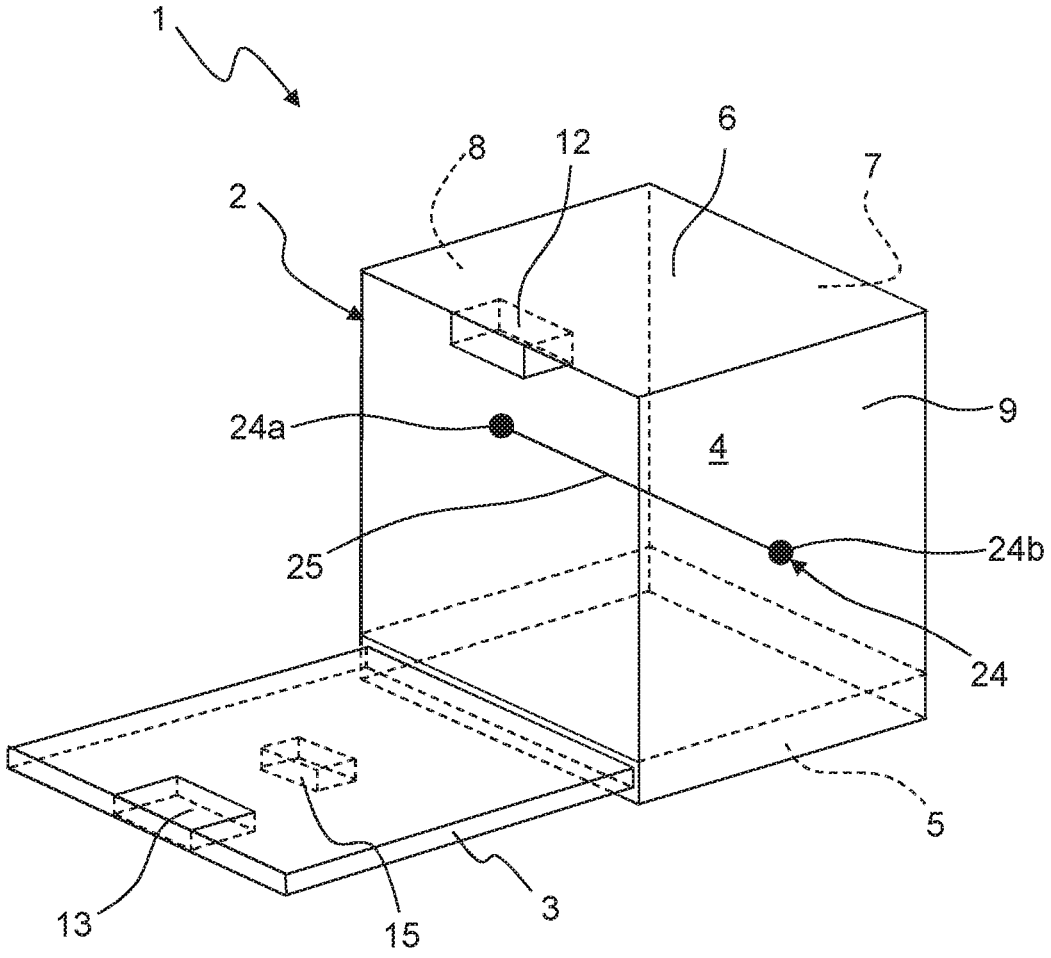
FIG. 6 shows a schematic perspective view of a fifth embodiment of a water-conducting domestic appliance.

FIG. 6 shows a schematic perspective view of a fifth embodiment of a water-conducting domestic appliance 1. The fifth embodiment in FIG. 3 is based in particular on the first embodiment in FIG. 1 and has all the features of the first embodiment in FIG. 1.

The water-conducting domestic appliance 1 has a light barrier 24, which comprises a transmitter 24*a* and a sensor 24*b*, which are positioned opposite one another for example on the respective side wall 8, 9. The transmitter 24*a* is a light-emitting diode and emits a monochromatic light, for example a red light with a wavelength of 660 nm or an infrared light in a wavelength range from 880-940 nm, in the direction of the sensor 24*b*.

The sensor 24*b* is a photodiode or phototransistor and receives the light emitted by the sensor 24*a*. A straight light beam 25 is therefore produced between the transmitter 24*a* and the sensor 24*b*, as illustrated schematically in FIG. 6. The transmitter 24*a* and the sensor 24*b* are positioned in such a manner that that when an item to be washed that is too large for the respective loading level 10 is loaded into the loading level 10, the light beam 25 is interrupted. When the light beam 25 is interrupted, the transmitter 24*a* or the sensor 24*b* can generate a control signal and transfer it to the control unit 25. The control unit 15 then generates information for the user, indicating that the item to be washed that has just been loaded may disrupt operation of the water-conducting domestic appliance 1. This information can be output optically and/or acoustically by the output unit 14 of the water-conducting domestic appliance 1.

Figure 7:
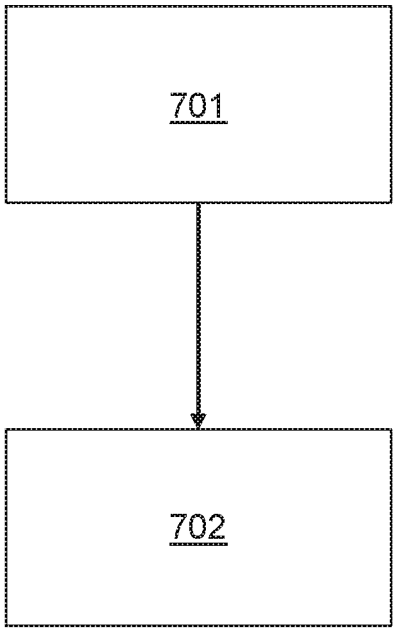
FIG. 7 shows schematic flow diagram of an exemplary embodiment of a method for operating a water-conducting domestic appliance.

FIG. 7 shows an exemplary embodiment of a method for operating a water-conducting domestic appliance, in particular a domestic dishwasher. The method in FIG. 7 is suitable in particular for operating the embodiments of the water-conducting domestic appliance 1 described above.

In step 701 a type of item to be washed is detected as said item to be washed is being loaded into the water-conducting domestic appliance.

In step 702 a signal is output, which carries information for a user of the water-conducting domestic appliance. The information is generated as a function of the detected type of item to be washed.

Although the present invention has been described based on exemplary embodiments, it can be modified in many different ways. In particular the features described for the embodiments of the water-conducting domestic appliance 1 can be applied correspondingly to the method.

The invention claimed is:

1. A water-conducting domestic appliance, comprising:

a detection unit configured to detect a type of item to be washed as the item is loaded into the water-conducting domestic appliance, the detection unit being configured to detect the type of item to be washed by detecting a spatial extension and a material of construction of the item to be washed being loaded into the water-conducting domestic appliance;

an image acquisition unit configured to acquire an image of the item to be washed, said detection unit being configured to detect the type of item to be washed in response to the image of the item in the water-conducting domestic appliance acquired by the image acquisition unit; and an output unit configured to output a signal carrying information for a user as a function of the detected type of item.

2. The water-conducting domestic appliance of claim 1, further comprising a wash container, said water-conducting domestic appliance being configured to determine an arrangement of the item in response to a detection of the type of the item and a position of the item in the wash container, to compare the arrangement of the item with a previously stored arrangement, and to store the determined arrangement.

3. The water-conducting domestic appliance of claim 2, wherein the water-conducting domestic appliance is configured to recognize a reproducibility of the previously stored arrangement in the determined arrangement and, when reproducibility is affirmed, to determine a predefined position in the wash container according to the determined arrangement and/or the previously stored arrangement.

4. The water-conducting domestic appliance of claim 1, wherein the detection unit further comprises an optical detection unit configured to optically detect the type of item to be washed.

5. The water-conducting domestic appliance of claim 1, further comprising a recording unit configured to record a position and the type of item to be washed in the water-conducting domestic appliance.

6. The water-conducting domestic appliance of claim 1, further comprising a memory unit configured to store a position and the type of item to be washed in the water-conducting domestic appliance.

7. The water-conducting domestic appliance of claim 1, further comprising a wash container, wherein the information outputted by the output unit includes a predefined position of the item to be washed in the wash container.

8. The water-conducting domestic appliance of claim 1, wherein the output unit is configured to optically output the signal carrying the information for the user.

9. The water-conducting domestic appliance of claim 1, wherein the information outputted by the output unit comprises a warning message, when the detected type of the item corresponds to a reference type.

10. The water-conducting domestic appliance of claim 1, wherein the detection unit is configured to recognize the type and/or position of the item using pattern recognition.

11. The water-conducting domestic appliance of claim 1, wherein the output unit is configured to transmit the signal carrying the information for the user to an external output facility.

12. The water-conducting domestic appliance of claim 1, further comprising a wash container and at least one light barrier configured to monitor the type and/or position of the item to be washed in the wash container.

13. The water-conducting domestic appliance of claim 1, further comprising a wash container, said detection unit being positioned on the wash container.

14. The water-conducting domestic appliance of claim 1, further comprising a wash container, and a door for opening and closing the wash container, said detection unit being positioned on the door.

15. A method for operating a water-conducting domestic appliance, comprising:

detecting a type of item to be washed as the item is loaded into the water-conducting domestic appliance, the detecting of the type of item to be washed includes detecting a spatial extension and a material of construction of the item to be washed while being loaded into the water-conducting domestic appliance;

acquiring an image of the item to be washed, wherein the type of item to be washed is detected in response to the acquired image of the item; and outputting a signal from an output unit, the signal carrying information for a user as a function of the detected type of item to be washed.

16. The method of claim 15, further comprising:

determining an arrangement of the item in response to a detection of the type of the item and a position of the item in a wash container of the water-conducting domestic appliance, comparing the arrangement of the item with a previously stored arrangement, and storing the determined arrangement.

17. The method of claim 16, further comprising:

recognizing a reproducibility of the previously stored arrangement in the determined arrangement and, when reproducibility is affirmed, determining a predefined position in the wash container according to the determined arrangement and/or the previously stored arrangement.

18. The method of claim 15, wherein the detecting further includes optical detection.

19. The method of claim 15, further comprising recording a position and the type of item to be washed in the water-conducting domestic appliance.

20. The method of claim 15, further comprising storing a position and the type of item to be washed in a memory unit.

21. The method of claim 15, wherein the information outputted by the output unit includes a predefined position of the item to be washed in a wash container of the water-conducting domestic appliance.

22. The method of claim 15, wherein the signal carrying the information for the user is outputted optically.

23. The method of claim 15, wherein the information outputted by the output unit comprises a warning message, when the detected type of the item corresponds to a reference type.

24. The method of claim 15, wherein the type and/or a position of the item to be washed is detected using pattern recognition.

25. The method of claim 15, further comprising transmitting the signal carrying the information for the user to an external output facility.

26. The method of claim 15, further comprising monitoring the type and/or a position of the item to be washed by at least one light barrier.

27. The method of claim 15, further comprising placing a detection unit to detect the type of item to be washed on a wash container of the water-conducting domestic appliance.

28. The method of claim 15, further comprising placing a detection unit to detect the type of item to be washed on a door for opening and closing a wash container of the water-conducting domestic appliance.

* * * * *